US006648991B2

(12) United States Patent
Turconi et al.

(10) Patent No.: US 6,648,991 B2
(45) Date of Patent: Nov. 18, 2003

(54) LOW-ALLOY CARBON STEEL FOR THE MANUFACTURE OF PIPES FOR EXPLORATION AND THE PRODUCTION OF OIL AND/OR GAS HAVING AN IMPROVED CORROSION RESISTANCE, A PROCESS FOR THE MANUFACTURE OF SEAMLESS PIPES, AND THE SEAMLESS PIPES OBTAINED THEREFROM

(75) Inventors: Gustavo Javier López Turconi, Campana (AR); Teresa Estela Pérez, Capital Federal (AR); Juan Carlos González, Pcia de BsAs (AR)

(73) Assignee: Siderca S.A.I.C., Buenos Aires (AR)

( * ) Notice: Subject to any disclaimer, the term of this patent is extended or adjusted under 35 U.S.C. 154(b) by 0 days.

(21) Appl. No.: 10/097,449

(22) Filed: Mar. 13, 2002

(65) Prior Publication Data

US 2003/0019549 A1 Jan. 30, 2003

(30) Foreign Application Priority Data

Mar. 13, 2001 (AR) ..... P 01 01 01173

(51) Int. Cl.[7] ..... C22C 38/20; C22C 38/22; C22C 38/24; C21D 8/10

(52) U.S. Cl. ..... 148/320; 148/541; 148/547; 420/110; 420/111

(58) Field of Search ..... 420/110, 111; 148/334, 541, 547

(56) References Cited

U.S. PATENT DOCUMENTS 6,379,611 B1 * 4/2002 Komai et al. ..... 420/106
6,406,564 B1 * 6/2002 Muraki et al. ..... 148/333
6,540,848 B2 * 4/2003 Miyata et al. ..... 148/336

* cited by examiner

*Primary Examiner*—Deborah Yee
(74) *Attorney, Agent, or Firm*—Thomas W. Tolpin; Welsh & Katz, Ltd.

(57) ABSTRACT

Low-alloy carbon steel for the manufacture of seamless pipes having improved resistance to corrosion, particularly the "sweet corrosion" that occurs in the media rich in $CO_2$, for using in exploration and production of oil and/or natural gas. The steel contains: 1.5–4.0% by weight of Cr, 0.06–0.10% by weight of C, 0.3–0.8% by weight of Mn, not more than 0.005% by weight of S, not more than 0.015% by weight of P, 0.20–0.35% by weight of Si, 0.25–0.35% by weight of Mo, 0.06–0.9% by weight of V, approximately 0.22% by weight of Cu, approximately 0.001% by weight of Nb, approximately 0.028% by weight of Ti, not more than a total value of O of 25 ppm, with the balance being Fe and unavoidable impurities. The process to manufacture seamless pipes comprises the stages of elaboration of a primary melt, followed by a secondary metallurgy stage with a strong desulfurization, addition of ferroalloys and chromium, and then the modification and flotation of the inclusions until the specified formulation is achieved; followed by casting, continuous hot-rolling, and optionally by normalizing, austenizing, quenching and tempering,

11 Claims, 7 Drawing Sheets

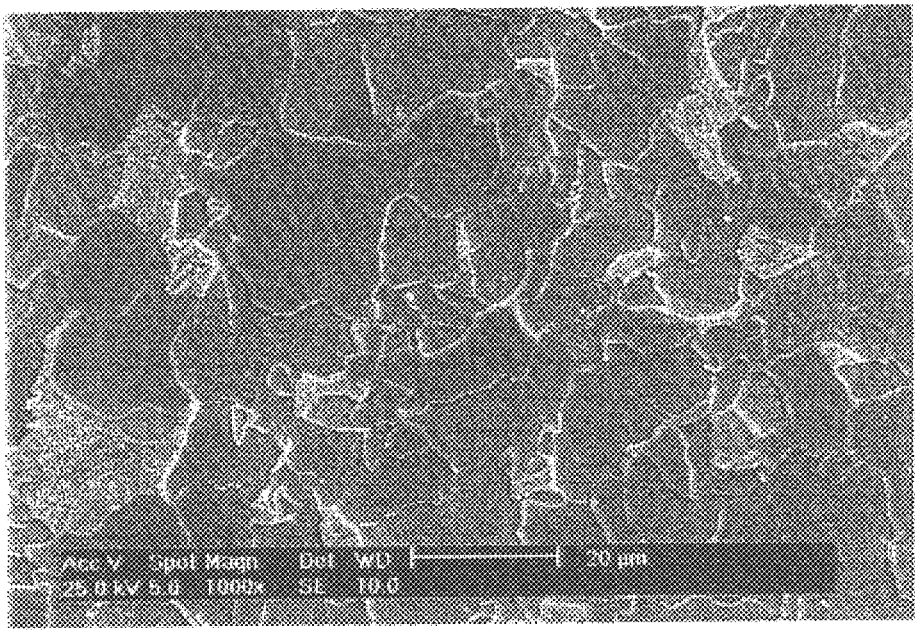
Figure 1: 3% Cr steel, as Rolled
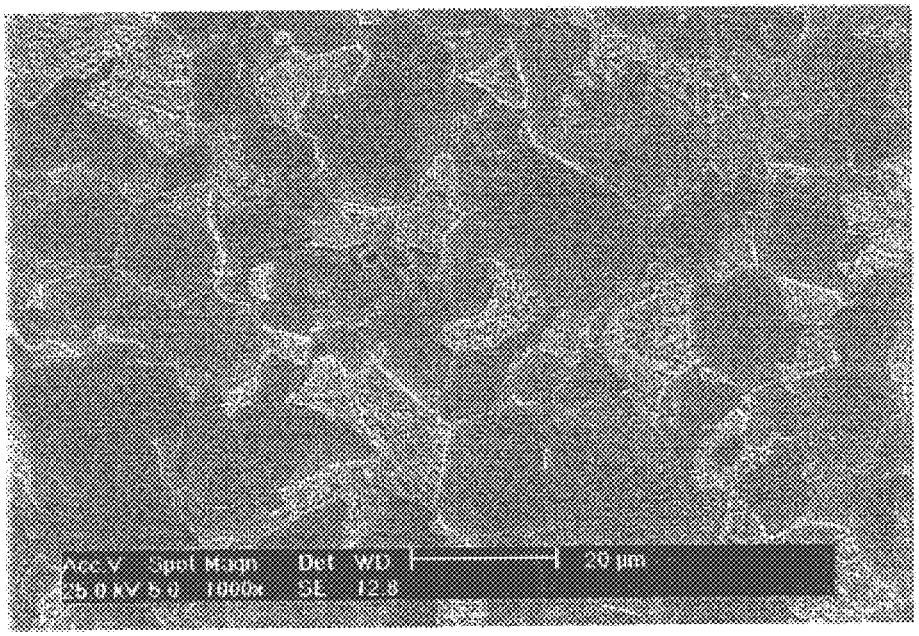
Figure 2: 3% Cr steel, Normalized

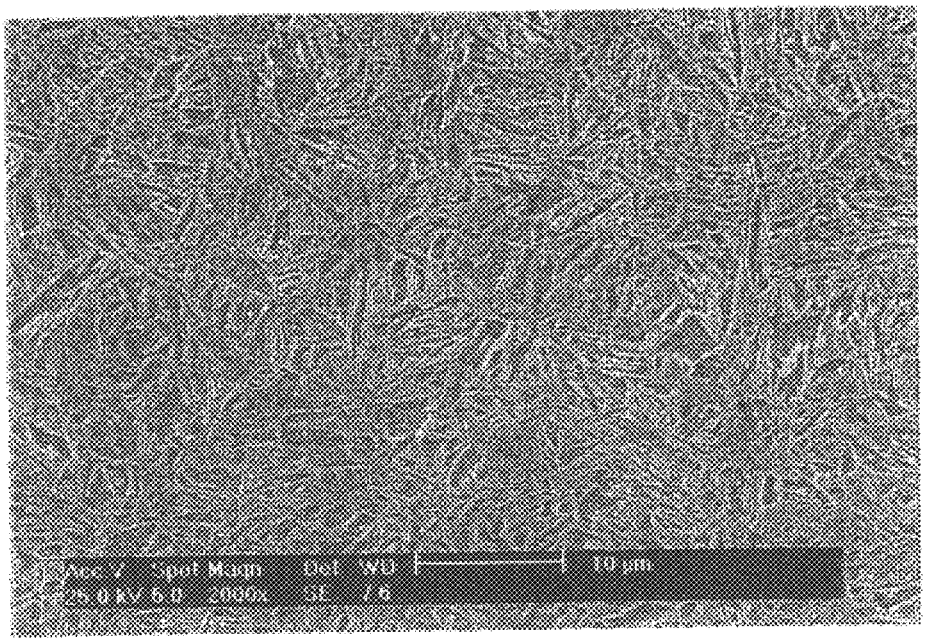
Figure 3: 3% Cr steel, as Quenched
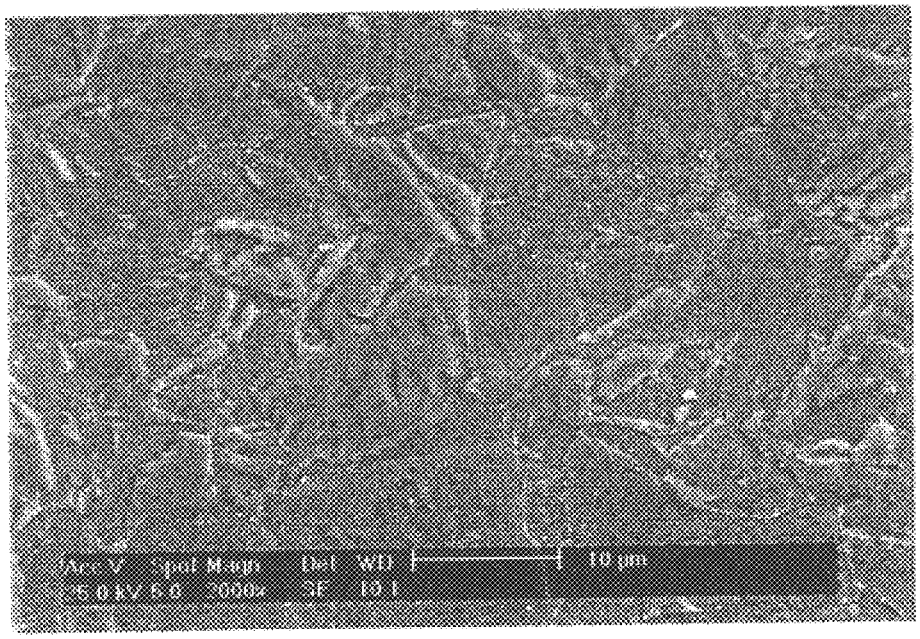
Figure 4: 3% Cr steel, Tempered

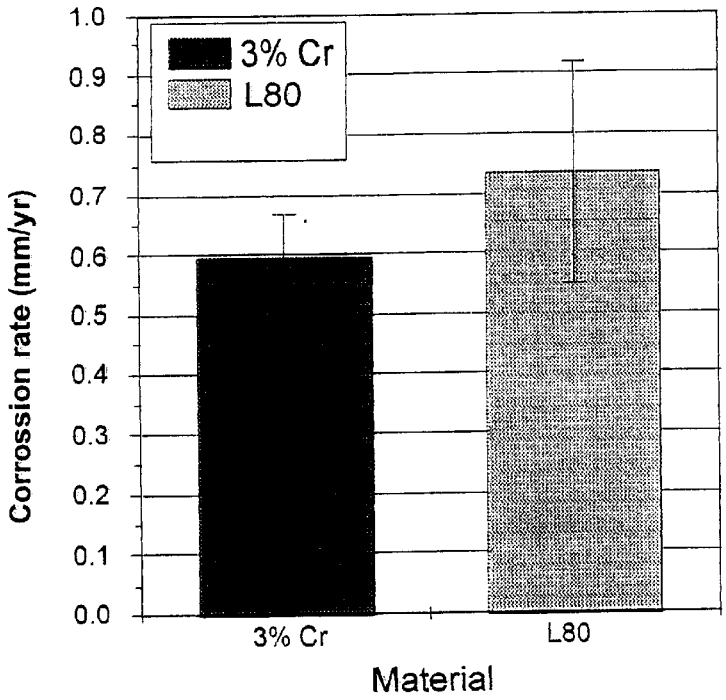
Figure 5: Corrosion rate by LPR, 25°C
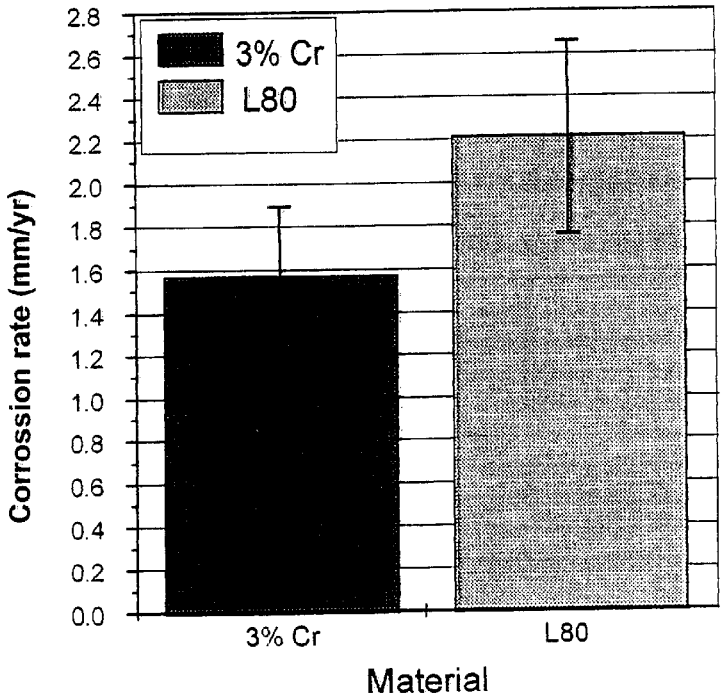
Figure 6: Corrosion rate by LPR, 60°C

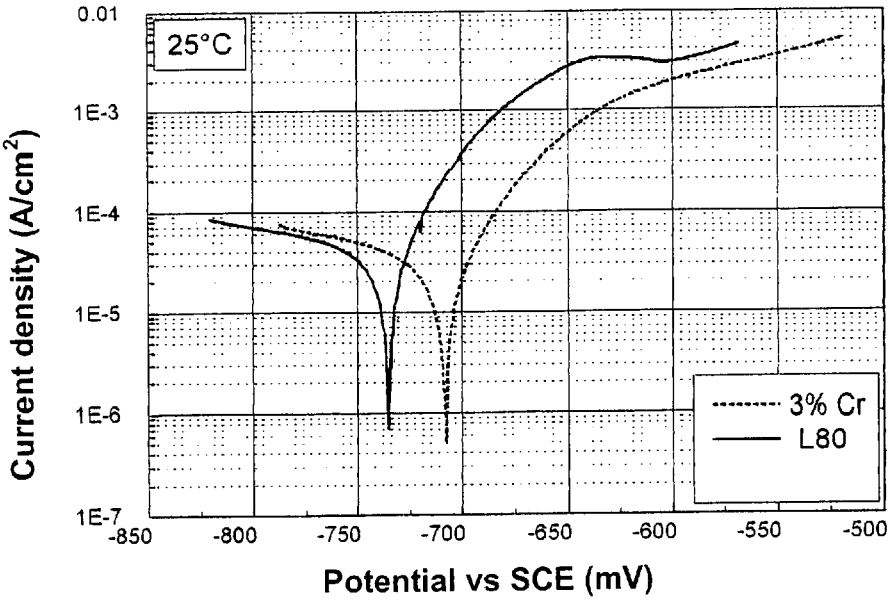
Figure 7: Potentiodynamic curves, 25°C
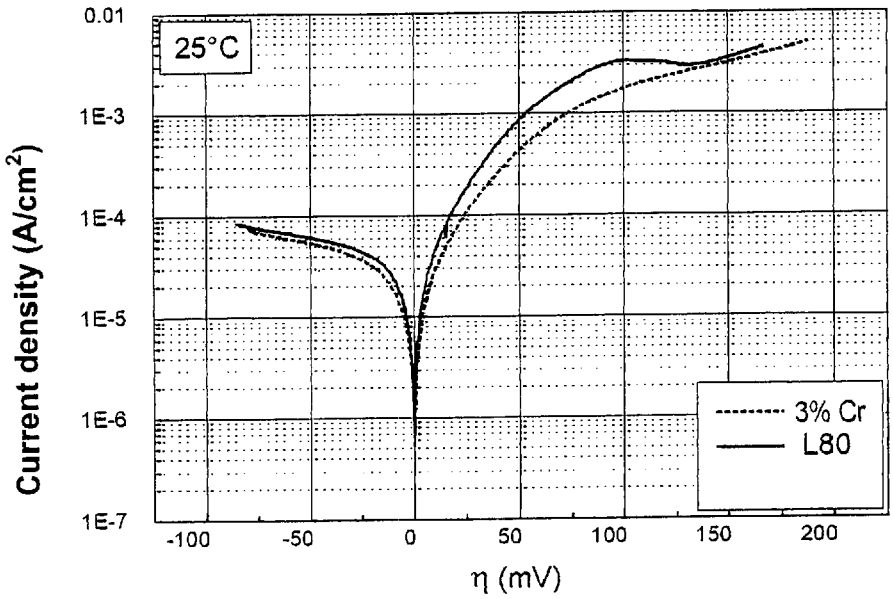
Figure 8: Current-Over-potencial curves, 25°C

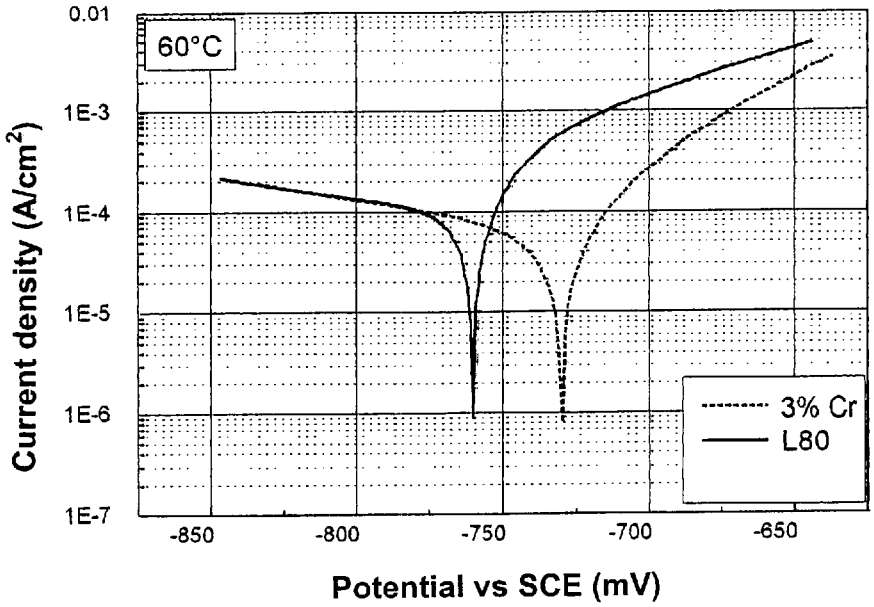
Figure 9: Potentiodynamic curves, 60°C
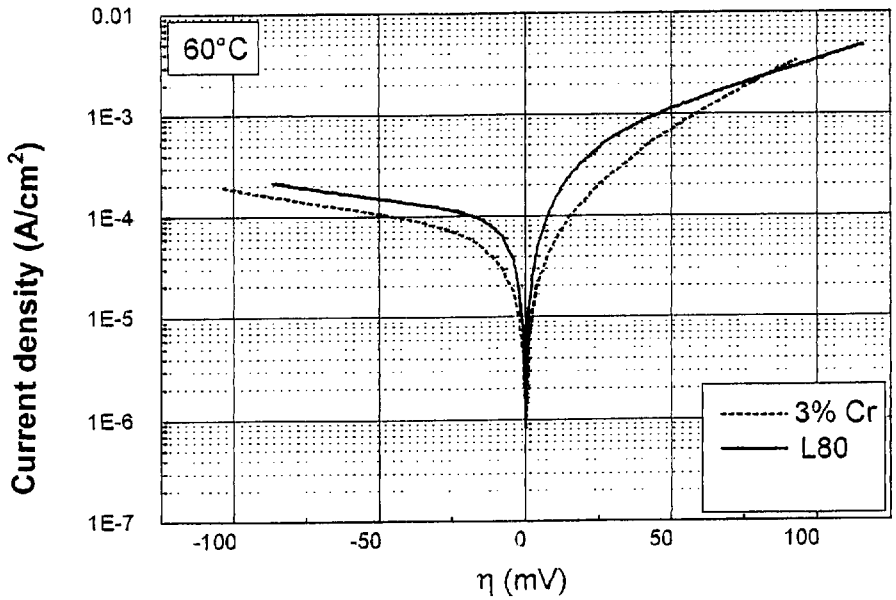
Figure 10: Current-Over-potencial curves, 60°C

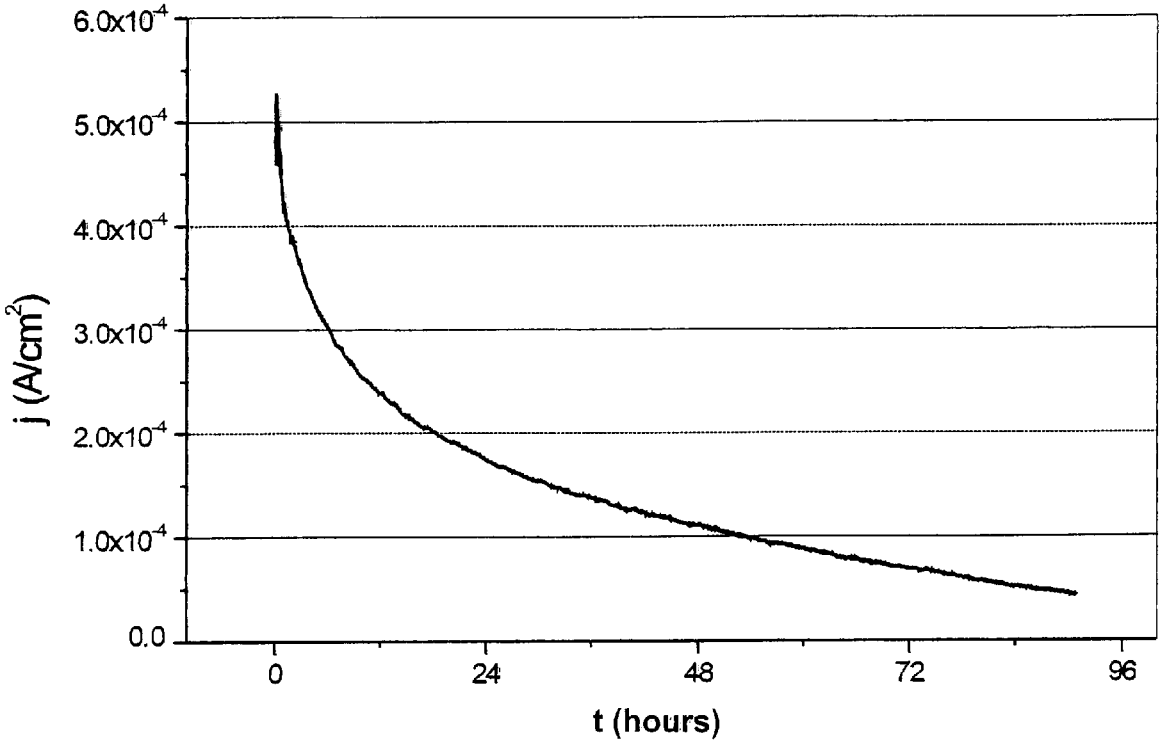
Figure 11: Potentiostatic Assay, Current vs Time

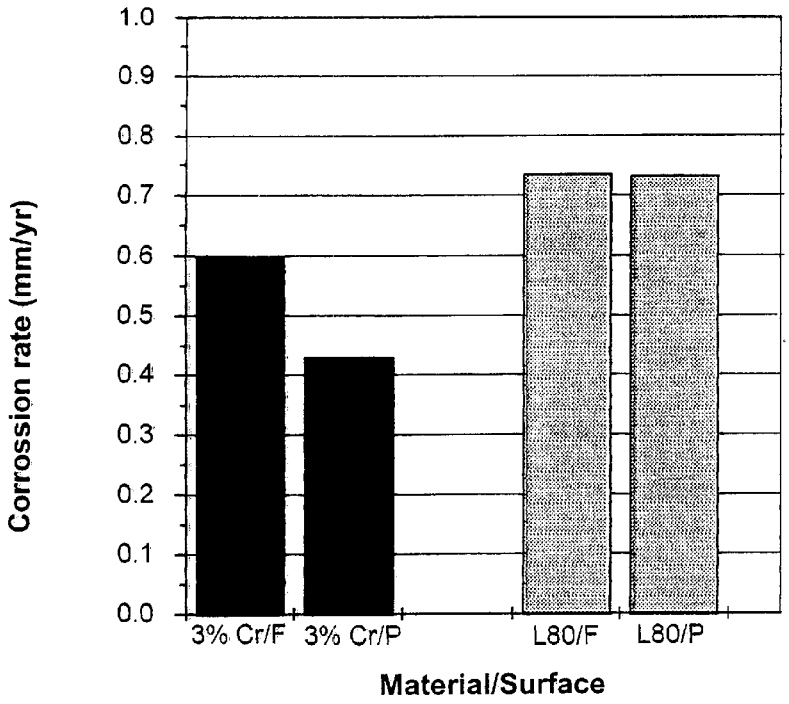
Figure 12: Corrosion rate by LPR, pre-corroded probes, 25
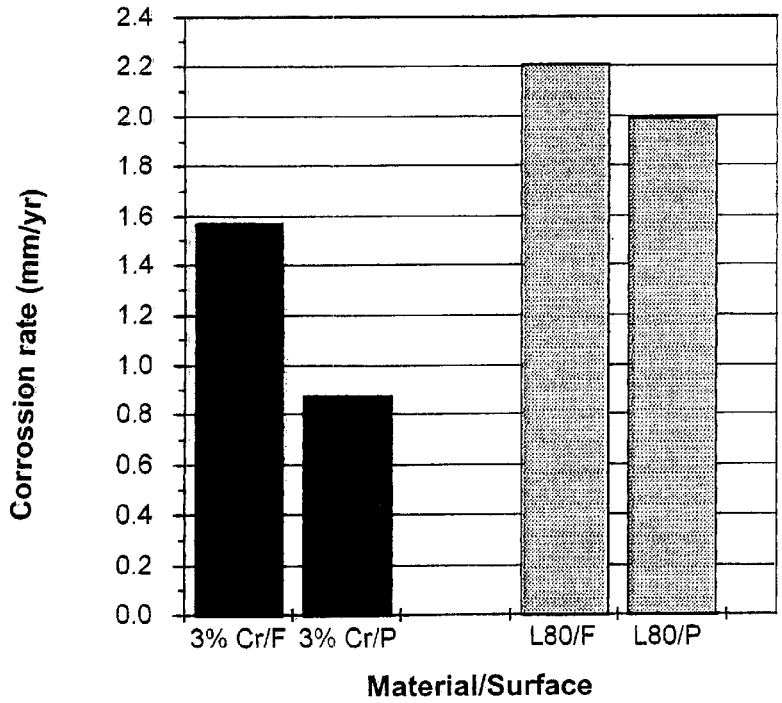
Figure 13: Corrosion rate by LPR, pre-corroded probes, 60°C

LOW-ALLOY CARBON STEEL FOR THE MANUFACTURE OF PIPES FOR EXPLORATION AND THE PRODUCTION OF OIL AND/OR GAS HAVING AN IMPROVED CORROSION RESISTANCE, A PROCESS FOR THE MANUFACTURE OF SEAMLESS PIPES, AND THE SEAMLESS PIPES OBTAINED THEREFROM

FIELD OF THE INVENTION

This invention relates to certain kinds of steel having a higher resistance to corrosion for their application in the manufacture of pipes used for oil and/or gas exploration and production in the petroleum industry. Particularly, the invention refers to a low-carbon steel having an improved resistance to corrosion, which is suitable for applications in the oil industry and particularly in environments containing $CO_2$.

BACKGROUND OF THE INVENTION

Corrosion has a wide range of implications on the integrity of materials used in the oil industry. Among the different ways in which corrosion may appear there is the so-called "sweet corrosion" that occurs in the media rich in $CO_2$. This is one of the prevailing ways of corrosion that must be faced when producing oil and gas.

The damage produced by corrosion caused by $CO_2$ has an impact on capital and operational investment, as well as on health, security, and environmental impact. In general terms, 60% of the failures occurring in the oil wells are the result of the corrosion caused by $CO_2$. This is mainly due to the poor resistance depicted by the low-alloy carbon steel commonly used in the oil producing industry when faced to this kind of attacks.

It has been shown that, despite the extensive research carried out during the last years in connection with the poor resistance to the corrosion caused by $CO_2$ observed in the low-alloy carbon steel, this has only led to the over-specification of materials, adversely impacting on the oil and gas production costs.

Carbon steel is usually used in tubes for the production of oil, for example J55, N80 or P110, having the following typical composition ranges: C: 0.20–0.45%; Si: 0.15–0.40%; Mn: 0.60–1.60%; S: 0.03% maximum; P: 0.03% maximum; Cr: 1.60% maximum; Ni: 0.50% maximum; Mo: 0.70% maximum; and Cu: 0.25% maximum.

Corrosion inhibitors have been generally used to offset the corrosive influence of the fluid medium present in an oil exploration and production facility. These inhibitors may be added to the fluid or to the injection water. To that end, filmogenic amines are commonly used. They act by generating a protective film over the metal surface, which protects such surface against the aggressive fluid. They are applied at constant doses of 8–20 mg/l or in weekly batches of 100–200 mg/l. However, these additions largely increase production costs.

As an attempt to counteract the corrosive influence of the fluid media present in an oil production facility, low-alloy carbon steel provided with different kinds of linings such as epoxy-type polymer resins or ceramic linings have been used.

Apart from their cost, these linings are severely damaged by the different tools used while working in the installation inside the well.

Due to the reasons mentioned above herein, the search has recently focused on the production of corrosion-resistant materials, which would make it possible to avoid the addition of such inhibitors and to eliminate pipe-linings.

A proposal was made to use high-chromium steel containing 10% by weight of Cr or more in the manufacture of production tubing. This kind of stainless steel, particularly stainless steel such as AISI420, AISI316, and Duplex (Cr: 22%) with a Cr content going from approximately 12 to 22%, regardless of the fact they have a desirable behavior against corrosion, have a high cost as their main disadvantage. This cost varies between 3 to 15 times the cost of conventional carbon steels.

Therefore, it would be desirable to rely on a steel suitable for the manufacture of cost-effective and corrosion-resistant pipes for the production of oil and/or natural gas.

It is known in the art that a low Cr content (of approximately 3%) is effective in improving the resistance to corrosion of low-alloy steel by means of the creation of a stable protective chromium oxide film. Nevertheless, such beneficial action resulting from the use of chromium could be offset if the carbon concentration and the micro-alloy elements are not modified. Furthermore, said composition should not only be useful to resist corrosion but it should also need to be suitable for the process of manufacturing seamless pipes and to provide high resistance and high tensile strength whenever mechanical stresses are applied. In addition, it should provide good weldability properties, without substantially increasing the cost when compared with conventional carbon steel.

BRIEF SUMMARY OF THE INVENTION

Therefore, it is an object of the present invention to provide a low-alloy carbon steel having a chromium content ranging from 1.5 to 4% by weight for the manufacture of the seamless pipes to be used in corrosive oil media, both for exploration and production in the well.

Furthermore, it is an object of the present invention to provide low-alloy carbon steel for the manufacture of seamless pipes for the exploration and the production of oil and/or natural gas having an improved resistance to corrosion, where the steel comprises: 1.5–4.0% by weight of Cr, 0.06–0.10% by weight of C, 0.3–0.8% by weight of Mn, not more than 0.005% by weight of S, not more than 0.015% by weight of P, 0.20–0.35% by weight of Si, 0.25–0.35% by weight of Mo, 0.06–0.9% by weight of V, approximately 0.22% by weight of Cu, approximately 0.001% by weight of Nb, approximately 0.028% by weight of Ti, not more than a total 0 of 25 ppm, with the balance being Fe and unavoidable impurities.

According to a preferred embodiment, the steel is produced following a process that comprises the stages stated below:

- the elaboration of a primary melt in an ultra-high power electric furnace, followed by a secondary metallurgy stage with a strong desulfurization, addition of ferroalloys and Cr, and then modification and flotation of inclusions until the specified formulation is obtained;
- casting, preferably by continuous casting, followed by hot-rolling in a continuous roller;
  - optionally, such hot-rolled steel is subjected to a normalizing thermal treatment;
  - optionally, said normalized steel is subjected to austenization, followed by quenching and tempering, with a minimum tempering temperature of 490° C.;
  - optionally, such rolled steel is directly subjected to austenization, quenching, and tempering.

Preferably, the hot-rolling comprises:

a first heating stage conducted at temperatures ranging between 1200–1300° C. for a period of approximately 60 minutes in an atmosphere of combustion gases with an $O_2$ content from 1 to 1.5%;

an optional second heating stage conducted at a temperature ranging between 850 and 1100° C. for a period of approximately 30 minutes, in an atmosphere of combustion gases with an $O_2$ content from 1 to 1.5%;

Preferably, the hot-rolling of seamless pipes is carried out in a continuous roller of the floating or restrained mandrel type (Multi-stand Pipe Mill—MPM—or Continuous Mandrel Mill, respectively).

According to one particular embodiment of the present invention, low-alloy carbon steel is provided for the manufacture of the pipes used in the exploration and the production of oil and/or natural gas with an improved resistance to corrosion. This steel containing: 3.3% by weight of Cr, 0.08% by weight of C, 0.47% by weight of Mn, 0.001% by weight of S, 0.014% by weight of P, 0.28% by weight of Si, 0.29% by weight of Mo, 0.52% by weight of V, 0.22% by weight of Cu, 0.001% by weight of Nb, 0.028% by weight of Ti, not more than a total 0 of 25 ppm, with the balance being Fe and unavoidable impurities.

Surprisingly, it has been found that a higher resistance to the corrosion caused by $CO_2$ can be obtained with respect to the conventional grade carbon steel recommended for the oil industry, also having suitable mechanical properties in terms of tensile strength and weldability.

An aspect of the invention consists of providing low-alloy carbon steel for the manufacture of an oil well casing with an improved resistance to corrosion, wherein such steel contains: 1.5–4.0% by weight of Cr, 0.06–0.10% by weight of C, 0.3–0.8% by weight of Mn, not more than 0.005% by weight of S, not more than 0.015% by weight of P, 0.20–0.35% by weight of Si, 0.25–0.35% by weight of Mo, 0.06–0.9% by weight of V, approximately 0.22% by weight of Cu, approximately 0.001% by weight of Nb, approximately 0.028% by weight of Ti, not more than a total 0 of 25 ppm, with the balance being Fe and unavoidable impurities.

Furthermore, another aspect of the invention consists of providing steel for the manufacture of a corrosion-resistant oil well production tubing which is made of a steel containing: 1.5–4.0% by weight of Cr, 0.06–0.10% by weight of C, 0.3–0.8% by weight of Mn, not more than 0.005% by weight of S, not more than 0.015% by weight of P, 0.20–0.35% by weight of Si, 0.25–0.35% by weight of Mo, 0.06–0.9% by weight of V, approximately 0.22% by weight of Cu, approximately 0.001% by weight of Nb, approximately 0.028% by weight of Ti, not more than a total 0 of 25 ppm, with the balance being Fe and unavoidable impurities.

In addition, another aspect of the present invention consists of providing steel for the manufacture of corrosion-resistant casing for injection well, where said steel contains: 1.5–4.0% by weight of Cr, 0.06–0.10% by weight of C, 0.3–0.8% by weight of Mn, not more than 0.005% by weight of S, not more than 0.015% by weight of P, 0.20–0.35% by weight of Si, 0.25–0.35% by weight of Mo, 0.06–0.9% by weight of V, approximately 0.22% by weight of Cu, approximately 0.001% by weight of Nb, approximately 0.028% by weight of Ti, not more than a total 0 of 25 ppm, with the balance being Fe and unavoidable impurities.

In addition, and for the purposes of the present invention, the manufacture of accessories such as couplings, valves, gaskets, as well as pumps, hydrated hydrocarbons capturing batteries, tanks, etc. -i.e. all those accessories and devices used in the stages before the oil inflow into a treatment plant—should be considered as included within the general application concept for the steel subject matter of the present invention.

A more detailed explanation of the invention is provided in the following detailed description and appended claims along with the accompanying drawings.

BRIEF DESCRIPTION OF THE DRAWINGS

FIGS. 1 through 4 depict pictures of the microstructure of a steel in accordance with the invention (magnification, 2500).

FIGS. 5 and 6 represent the mean values and the standard deviation for the corrosion rate through measurements of the Linear Polarization Resistance at 25° C. and 60° C., respectively.

FIGS. 7 and 9 show the curves obtained by means of a potentiodynamic scan with bare probes at 25° C. and 60° C., respectively.

FIGS. 8 and 10 show the curves of current versus overpotential curves obtained with bare probes at 25° C. and 60° C., respectively.

FIG. 11 shows the effect of pre-corrosion in a trial measuring current versus time.

FIGS. 12 and 13 represent the mean values for the corrosion rate from the measurements of the Linear Polarization Resistance at 25° C. and 60° C., respectively using pre-corroded probes.

DETAILED DESCRIPTION OF THE INVENTION

A detailed description of preferred embodiments of low-alloy carbon steel of the present invention and its uses will now be explained. The inventive low-alloy carbon is useful for the manufacture of seamless pipes for the exploration and production of oil and/or natural gas and has improved resistance to corrosion. The inventive low-alloy carbon steel also has other uses.

The low-alloy carbon steel of the present invention comprises: 1.5–4.0% by weight of Cr, 0.06–0.10% by weight of C, 0.3–0.8% by weight of Mn, not more than 0.005% by weight of S, not more than 0.015% by weight of P, 0.20–0.35% by weight of Si, 0.25–0.35% by weight of Mo, 0.06–0.9% by weight of V, approximately 0.22% by weight of Cu, approximately 0.001% by weight of Nb, approximately 0.028% by weight of Ti, not more than a total 0 of 25 ppm, with the balance being Fe and unavoidable impurities, being such steel produced in accordance with a process comprising the stages of melting and casting said steel, preferably by continuous casting, The steel of the invention is made, on a first step, by preparing the primary melt in an ultra-high power electric furnace. The feeding line of the electric furnace is made up of a high percentage (over 40%) of Sponge Iron produced by direct reduction, thus guaranteeing a minimum content of residual elements. The elaboration in the electric furnace relies on a swollen slag process and a slag-free drain-out. Then, this initial steel is refined on a secondary metallurgy stage, inside a ladle furnace. This second stage is carried out under a continuous argon bubbling, with a strong desulfurization first, followed by an alloy stage with Cr and the remaining ferroalloys, then modification and flotation of the inclusions. The secondary metallurgy stage must be carried out maintaining a suitable level of agitation and avoiding re-oxidization to obtain the best anti-corrosive properties in steel. The steel is then cast with continuous casting using a maximum overheating of about 35° C. and a controlled superficial cooling of the bars in the continuous casting cooling-plane that should not exceeding an average of approximately 10° C./min at a temperature comprised between 900° C. and 500° C.

The Cr content present in the steel must be more than 1.5%, preferably about 3%, and more preferably 3.3%. The Cr present in these concentrations acts by promoting the formation of a stable protective chromium oxide film, thus offering an improved corrosion resistance to the low-alloy carbon steel of the invention.

In order to enhance the effect of the Cr added, it is necessary to maintain a high fraction of the Cr in solid solution as such. Thus, the formation of chromium carbides is minimized. Therefore, one of the outstanding features of the steel of the present invention consists of its low carbon content. A carbon content of less than 0.10% assures a lower formation of chromium carbides. However, a carbon content below 0.06% has proved to be inadequate when trying to reach the desired mechanical strength levels. Preferably, the C content in the steels of the invention is of 0.08% by weight.

Furthermore and in order to minimize the formation of chromium carbides, the addition of micro-alloys (V, Ti, Mo, Si, Cu) with a strong tendency to create carbides is included. Consequently, such elements will compete with chromium in the formation of carbides, leaving a sufficient concentration of Cr free in the solution and, therefore, providing an improved resistance to corrosion. To that effect, the V content should range between 0.06% and 0.9%, preferably it should be of 0.52% by weight and, the suitable Mo content should range between 0.25 and 0.35%, and preferably, it should be of 0.29% by weight.

Even though Ti also has an important tendency to form carbides, its concentration should be kept below 0.028% by weight. Higher Ti concentrations would hinder the toughness needed for the common uses found in the oil industry.

Again, Si can be used to compensate a possible reduction in the strength due to the carbon loss. However, its concentration should be kept between 0.20 and 0.35%, and preferably it should be of 0.28% by weight. A concentration exceeding 0.35% should be avoided in order to prevent the formation of high adherence oxides on the surface of the pipes since it produces defects resulting from incrustation.

The S content should be below 0.005% and, preferably it should be of 0.001%. A low sulfur content is necessary to avoid the localized corrosion associated with non-metallic particles and/or segregation.

The P content must be kept within ranges below 0.015% to prevent an excessive segregation that could be harmful in the event of being used in corrosive environments. If the P values are kept low, the tendency to cause structure banding is reduced.

It is necessary to keep a total 0 level below 25 ppm to reduce the presence of oxides and non-metallic inclusions acting as localized corrosion points.

Mn in concentrations comprised between 0.3 and 0.8%, preferably of 0.47% by weight, improves the mechanical strength of the steel.

The results of the comparative examples described below herein show that the steel of the invention has an improved resistance to corrosion. Without being fully bound to any theory in particular, we consider that we are faced to the formation of a stable protective chromium oxide film. This film with an adherent nature would constitute an effective barrier against localized attacks.

The steel of the present invention is produced according to a process comprising the stages of casting a steel that contains: 1.5–4.0% by weight of Cr, 0.06–0.10% by weight of C, 0.3–0.8% by weight of Mn, not more than 0.005% by weight of S, not more than 0.015% by weight of P, 0.20–0.35% by weight of Si, 0.25–0.35% by weight of Mo, 0.06–0.9% by weight of V, approximately 0.22% by weight of Cu, approximately 0.001% by weight of Nb, approximately 0.028% by weight of Ti, not more than a total 0 of 25 ppm, with the balance being Fe and unavoidable impurities. Preferably, this process is performed by continuous cast, followed by hot-rolling in a continuous roller for seamless pipes, of the floating or restrained mandrel type (Multi-stand Pipe Mill—MPM—o Continuous Mandrel Mill, respectively); subjecting said hot-rolled steel to a thermal normalizing treatment; and then optionally, by subjecting such normalized steel to austenization followed by quenching and tempering, with a minimum tempering temperature of 490° C.

The continuous rolling, according to the process of the invention, comprises a first heating stage conducted at temperatures substantially ranging between 1200–1300° C. for a period of at least 1 hour in an atmosphere of combustion gases with an $O_2$ content ranging from 1 to 1.5% and a first rolling and drilling stage of the initial material. Subsequently, the resulting drilling is rolled in the continuous roller until a variable reduction rate is obtained based on the desired final product. This reduction rate stands for approximately 70% of the initial drilling thickness at the roller inlet. At the end of this rolling stage, the steel temperature is substantially comprised within the range of 950–1150° C.

Optionally, the steel is heated again at a temperature comprised between 850–1100° C. in an atmosphere of combustion gases with an $O_2$ content ranging from 1 to 1.5% for a period of approximately 30 minutes. Then, this semi-processed product is subjected to a further reduction in its thickness and diameter until it reaches a reduction rate of up to 60% of the initial thickness recorded at the inlet of the second rolling stage.

The rolled material is then subjected to a normalizing thermal treatment and, optionally, to an austenization, quenching and tempering treatment in order to obtain a material having the mechanical properties of a product Grade J 55 and Grade N 80, respectively. The austenization, quenching, and tempering treatment can be also directly applied to the steel after rolling.

The rolled steel normalization is performed by subjecting the steel to a temperature comprised between about 850 and 950° C. for a period of about one hour, followed by cooling. Optionally, the steel can be subsequently heated until reaching the temperature at which it can be austenized. During that heating process, the steel preferably reaches a temperature level comprised between 850 and 950° C. The austenized steel is then preferably subjected to a fast cooling process. Such process can be carried out using water or oil, whereby it is possible to obtain a substantially martensitic structure. Finally, it is heated at a temperature that should not exceed the eutectoid point temperature, $Ac_1$ (tempering). Preferably, the tempering temperature will range between 500 and 720° C. The heating processes may be performed following any well-known method commonly used in the art.

In order to clearly illustrate the nature of the present invention, the following examples for preparing low-carbon steel to be used in the manufacture of seamless pipes according to the present invention that meet the mechanical requirements demanded by the exploration and production of oil and/or gas, are presented.

In addition, the comparative examples described below herein depict the enhanced response to localized and generalized corrosion found for the steel according to what is claimed in the present invention when compared to a steel usually applied in oil wells.

The following examples illustrate embodiments of the low-alloy carbon steel of the invention. These examples shall not be regarded as restricting the scope of the invention, as they are only examples of the low-alloy carbon steel according to the invention.

set forth by API Standard for Grade J55 steel with a ferritic-pearlitic microstructure.

Later, the normalized material was austenized (940° C., 30 minutes), cooled in air, and then it was subjected to 15 minutes periods of tempering at 680° C., 625° C., 650° C., 680° C., 700° C., and 720° C. This enabled the obtainment of a steel that met the mechanical requirements set forth by API Standard for Grade L80 steel. The N and O contents stood at 70 and 18 ppm, respectively.

Table I includes, in addition, the chemical composition of the steel commonly used for oil wells, which is designated as L80 (quenching and tempering, Grade L80). This steel was subsequently used in the comparative trials, as described below herein.

TABLE I

| | Chemical Composition | | | | | | | | | | |
|---|---|---|---|---|---|---|---|---|---|---|---|
| Material | C % | Mn % | S % | P % | Si % | Cr % | Mo % | V % | Cu % | Nb % | Ti % |
| Cr 3% | 0.08 | 0.471 | 0.001 | 0.014 | 0.28 | 3.3 | 0.29 | 0.52 | 0.22 | 0.001 | 0.028 |
| L80 | 0.27 | 1.36 | 0.004 | 0.013 | 0.29 | 0.03 | 0.02 | — | 0.12 | 0.001 | 0.021 |

Note The percentages (%) are expressed as w/w

EXAMPLE 1

Preparation—Composition

A chromium steel according to the invention and generally called 3% Cr steel, was made pursuant to the chemical composition specified in detail under Table I. A melting process was used to make the steel bars with a diameter of 170 mm in an ultra-high power electric furnace. The steel of the invention was made, on a first stage, by preparing the primary melt in an ultra-high power electric furnace. The feed of the electric furnace was made up of a high percentage (over 40%) of Sponge Iron derived from direct reduction, whereby a minimum content of residual elements was thus ensured. The elaboration in the electric furnace was conducted using a swollen slag process and a slag-free drain-up. Then, this initial steel was refined in a secondary metallurgy stage using a ladle furnace. This second stage was performed with continuous argon bubbling. First, and at this point, a strong desulfurization was carried out, followed by an alloying stage with Cr and the other ferroalloys, modification and flotation of the inclusions. The secondary metallurgy stage must be performed keeping a suitable level of agitation and avoiding re-oxidation in order to obtain the best anti-corrosive properties for the steel. The steel is cast by continuous casting with a maximum overheating of about 35° C. and with a controlled superficial cooling of the bars in the continuous casting cooling bed which should not exceed an average of approximately 10° C./min, at a temperature ranging between 900° C. and 500° C.

The cast pieces are then subjected to rolling in a continuous roller for seamless pipes (Continuous Mandrel Mill). The heating and rolling conditions comprised two stages. A first stage of rolling and drilling with a heating temperature ranging between 1200–1228° C. for a period of 60 minutes, in an atmosphere of combustion gases, and with an $O_2$ content from 1 to 1.5%, and a second stage with a heating temperature of 950° C. for a period of 30 minutes in an atmosphere of combustion gases with an $O_2$ content from 1 to 1.5%. The rolled pieces were then normalized (890° C., 1 hour), thus producing a material that met the specifications

EXAMPLE 2

Microstructural Characterization

The microstructural characterization of the 3% Cr steel of the invention obtained according to Example 1 was made using an optical and scan electronic microscopes (SEM). The rolled steel microstructure is shown in FIG. 1. This Figure shows the material is ferritic-pearlitic. In addition, it was proved that it had a minor presence of non-tempered martensite and bainite.

The microstructure of the normalized material is illustrated in FIG. 2. This Figure shows that the material is ferritic-pearlitic. The pearlite is laminar, and the ferritic grain size is of approximately 10 microns.

The steel microstructure in a "as quenched", and quenched and tempered (at 680° C., 15 minutes) conditions is shown in FIGS. 3 and 4. These figures show that the resulting material is mostly martensitic.

The observed microstructures correspond to the microstructures expected for normalized steel of the J55 and Grade N80 type.

EXAMPLE 3

Mechanical Properties

The mechanical properties for the chromium steel of the invention were determined according to Example 1. These determinations were made using API probes. The results are summarized in the following Table II:

TABLE II

| | Mechanical Properties | | | | |
|---|---|---|---|---|---|
| Heat Treatment | YS (Ksi) | UTS (Ksi) | ΔL/L | YS/ UTS | Hardness BHN |
| As rolled | 55 | 90.1 | 31.9 | 0.610 | 167 |
| Normalized | 59 | 88.27 | 30.3 | 0.667 | 204 |
| Tempered at 720 | 90.5 | 102.47 | 24.8 | 0.883 | 223 |

TABLE II-continued

| Heat Treatment | Mechanical Properties YS (Ksi) | UTS (Ksi) | ΔL/L | YS/UTS | Hardness BHN |
|---|---|---|---|---|---|
| Tempered at 700 | 99.2 | 110.3 | 26.2 | 0.899 | 230 |
| Tempered at 680 | 103.3 | 109.1 | 21 | 0.947 | 223 |
| Tempered at 650 | 127.5 | 135.7 | 20 | 0.940 | 302 |
| Tempered at 625 | 137.9 | 152.9 | 16.7 | 0.902 | 341 |
| Tempered at 600 | 135.2 | 155.8 | 18 | 0.868 | 341 |

The results reflect that the 3% Cr steel of the invention has mechanical properties similar to those seen for the other kinds of steel commonly used in the relevant grades.

In addition, Charpy assays were conducted (impact strength assay). To conduct this assay probes having a dimension of 10 mm×5 mm were used. All the probes were LC probes. The results have been summarized in Table III. These results indicate that the materials assessed have toughness similar to those seen for the other kinds of steel commonly used in the relevant grades.

TABLE III

| Heat Treatment | Tensile Strength YS (Ksi) | | Charpy Assay (LC 10 × 5 mm) 21° C. | 0° C. | −20° C. | −45° C. |
|---|---|---|---|---|---|---|
| As Rolled | 55.9 | CVN (J) | 129.3 | 142.6 | 136.0 | 123.3 |
| | | S.A. (%) | 100.0 | 100.0 | 100.0 | 100.0 |
| Normalized | 59.0 | CVN (J) | 85.3 | 54.3 | 34.3 | 10.0 |
| | | S.A. (%) | 81.0 | 39.0 | 26.0 | 5.0 |
| Tempered at 720° C., 15' | 90.5 | CVN (J) | 106.6 | 119.3 | 108.0 | 93.0 |
| | | S.A. (%) | 100.0 | 100.0 | 100.0 | 93.0 |
| Tempered at 700° C., 15' | 99.2 | CVN (J) | 100.6 | 104.0 | 105.0 | 92.0 |
| | | S.A. (%) | 100.0 | 100.0 | 100.0 | 100.0 |
| Tempered at 680° C., 15' | 103.3 | CVN (J) | 94.6 | 102.6 | 93.3 | 76.6 |
| | | S.A. (%) | 100.0 | 100.0 | 100.0 | 86.0 |

EXAMPLE 4

Corrosion Assays in the Laboratory

The corrosion assays in the laboratory were conducted using glass cells and a static and rotating electrode.

The probes used in the rotary electrode system were cylinders having an external diameter of 12 mm and an internal diameter of 6.63 mm. They were used so as to establish a good electric contact with the system metal axis.

As the assay medium a synthetic aqueous solution simulating formation waters was used under high-purity $CO_2$ continuous bubbling. Tables IV and V summarize and show the main assay parameters, jointly with the composition of the solution.

TABLE IV

| | |
|---|---|
| Flow equivalent speed (m/s) | 0 and 2.5 |
| Temperature (° C) | 25 and 60 |
| Total pressure (bar) | 1 |
| $CO_2$ continuous bubbling | |
| PH | 5.4 |

TABLE V

| Ionic | Brine Composition mg/l | Compound | g/l |
|---|---|---|---|
| $Cl^-$ | 75000 | NaCl | 119.1 |
| $SO_4^-$ | 1400 | $MgSO_47H_2O$ | 3.59 |
| $HCO_3^-$ | 900 | $KHCO_3$ | 1.5 |
| $Ca_2^+$ | 1500 | $CaCl_2.2H_2O$ | 5.5 |
| $Mg_2^+$ | ≈350 | | |
| $Na^+ + K^+$ | ≈47500 | | |

Following, the corrosion performance assessment for the chromium steel of the invention was conducted. This steel was obtained according to Example 1. To that effect, different techniques were used: A) Linear Polarization Resistance (LPR), at 25 and 60° C.; B) Potentiodynamic Scans for bare probes; C) Current versus Time Potentiostatic Assays; and D) Linear Polarization Resistance for pre-corroded probes.

A. Linear Polarization Resistance (LPR)

The results of these assays appear in FIG. 5 (assays at 25° C.) and FIG. 6 (assays at 60° C.).

In the LPR assays conducted at 25° C., the mean rate corrosion value (for a minimum of five determinations per material) of the 3% Cr steel of the invention was lower than the value found for the L80 steel of the previous art. The 3% Cr steel corrosion rate stood for about 0.6 mm/year, while the rate for L80 steel reached 0.74 mm/year, with a $V_{curr}$.Cr 3/$V_{curr}$.L80 $|_{25°\ C.}$ ratio=0.81.

As expected, in the assays conducted at 60° C., a strong increase in the corrosion rate for all the materials was observed with respect to the values determined at 25° C. The lowest rate was, again, seen for the 3% Cr steel of the invention (approximately 1.56 mm/year). On the other hand, the corrosion rate of the L80 material stood for 2.2 mm/year, having a $V_{curr}$.Cr 3/$V_{curr}$.L80 $|_{60°\ C.}$ ratio=0.71.

B. Potentiodynamic Scans Using Bare Probes

FIGS. 7 through 10 illustrate the curves obtained using bare probes. In all these cases, scans were made until a current density of approximately 0.005 A/cm$^2$ was obtained. The currents measured during the scanning were generally expressed in terms of the potential applied (to compare corrosion potentials) as well as in terms of the over-potential applied to them (allowing a better comparison against the current values obtained per material, at constant over-potential). No localized corrosion was detected by the observation under the optical or the scan electronic microscope.

FIGS. 7 and 8 illustrate the results obtained for 3% Cr steel of the invention tested at 25° C. In both graphics, a comparison of their performance was made against that of L80 steel. A shift in the corrosion potential toward more noble values was observed for the 3% Cr steel. The anodic currents (dissolution of the material) grew nearly in a continuous way when there was an increase in the potential (FIG. 7).

When drawing the current based on the over-potential applied during the assay (FIG. 8), it could be seen that the anode branch of the 3% Cr steel was below that of the material of the previous art. This is an indication of a lower dissolution rate for the chromium steels of the invention.

FIGS. 9 and 10 depict the results of the scans conducted at 60° C. for the 3% Cr steel of the invention. Furthermore, this includes a comparison of its performance against that of the L80 steel from the previous art. FIG. 9 shows that high-chromium steel (Cr 3%) appears to be nobler when compared with the L80 steel. As it could be seen at 25° C., the anode branch of the high-chromium steel was below that of the L80 steel (see FIG. 10). Thus, this indicates a lower dissolution rate for the chromium steels of the invention at a given over-potential.

C. Potentiostatic Assays: Current Versus Time

The current vs. time potentiostatic assays consisted of applying an initial given over-potential (in this case of +40 mV) to a bare probe (polished up to a sandpaper 600) maintaining this potential constant within the resulting value and recording the current based on time. This kind of assays made it possible to analyze the behavior of the materials as corrosion developed, that is, in the presence of corrosive products, and consequently, to assess the possible protective nature thereof. The results obtained in the assay conducted at 60° C. are shown in FIG. 11.

FIG. 11 depicts the curve obtained for the 3% Cr steel of the invention. The results obtained indicate a lower corrosive feature, being more passive than the steels with no Cr or the steels with fewer alloys.

D. Linear Polarization Resistance (LPR) For Pre-Corroded Probes

After the current versus time assay that has been described in the foregoing item, the materials depict a corroded surface with deposits of corrosive products. If they are to be subjected to an LPR assay in such condition, the behavior of the material could be affected by the changes experienced by its surface during the corrosion process, and also by the presence of corrosive products.

The results of these assays are depicted in FIG. 12 (assays at 25° C.) and 13 (assays at 60° C.).

From the results obtained with the LPR conducted at 25° C. (FIG. 12) it could be seen that the mean corrosion rate for the pre-corroded probe is considerably lower (0.42 mm/year) than the mean corrosion rate recorded for the bare probe (0.60 mm/year) in the case of the 3% Cr steel of the invention. In the specific case of the steel used in the previous art, i.e. L80, no differences were detected in the corrosion mean rate between the bare and the pre-corroded probes (0.72 mm/year). In addition, such rate was significantly higher than the rate found both for the bare and the pre-corroded probes made of the Cr material (3%) of the invention. The rate ratio between these two pre-corroded samples was: $V_{curr}.Cr\ 3/V_{curr}.L80\ |_{25°\ C.}=0.59$.

As it was to be expected, in the assays conducted at 60° C. a strong increase in the corrosion mean rate for all the materials was observed with respect to the measurements determined at 25° C. Again, the lowest rate was found for the 3% Cr steel of the invention, which was of approximately 1.56 mm/year for the bare probes and of 0.85 mm/year for the pre-corroded probes. The corrosion rate of the L80 material stood for 2.2 mm/year for the bare probes and of 2.0 mm/year for the pre-corroded bars. The rate ratio between these two pre-corroded samples was: $V_{curr}.Cr\ 3/V_{curr}.L80\ |_{60°\ C.}=0.44$.

It can be concluded that the steels of the invention, with 3% Cr content, offer a better performance to carbon corrosion when compared with the steels commonly used in the oil industry. In addition, it could be seen that they meet the mechanical requirements (creeping, break and elongation strength) of the API standard for Grades J55, L80, N80, C95 and P110.

The foregoing are some particular embodiments of the invention. However, it must be understood that many changes and variations may be introduced without departing from the scope of the accompanying claims.

What is claimed is:

1. Low-alloy carbon steel for the manufacture of seamless pipes for the exploration and the production of oil and/or natural gas having an improved resistance to corrosion, wherein said steel contains:

1.5–4.0% by weight of Cr, 0.06–0.10% by weight of C, 0.3–0.8% by weight of Mn, not more than 0.005% by weight of S, not more than 0.015% by weight of P, 0.20–0.35% by weight of Si, 0.25–0.35% by weight of Mo, 0.06–0.9% by weight of V, approximately 0.22% by weight of Cu, approximately 0.001% by weight of Nb, approximately 0.028% by weight of Ti, not more than a total value of O of 25 ppm, with the balance being Fe and unavoidable impurities.

2. Low-alloy carbon steel for the manufacture of seamless pipes for the exploration and the production of oil and/or natural gas having an improved resistance to corrosion according to claim 1, wherein said steel contains:

1.5–4.0% by weight of Cr, 0.06–0.10% by weight of C, 0.3–0.8% by weight of Mn, not more than 0.005% by weight of S, not more than 0.015% by weight of P, 0.20–0.35% by weight of Si, 0.25–0.35% by weight of Mo, 0.06–0.9% by weight of V, approximately 0.22% by weight of Cu, approximately 0.001% by weight of Nb, approximately 0.028% by weight of Ti, not more than a total O of 25 ppm, with the balance being Fe and unavoidable impurities, being such steel produced according to a process comprising the following stages:

elaboration of a primary melt in a ultra-high power electric furnace, followed by a secondary metallurgy stage with a strong desulfurization, addition of ferroalloys and Cr, and then the modification and flotation of the inclusions until the specified formulation is achieved;

casting, preferably by continuous casting, followed by hot-rolling in a continuous roller;

optionally, such hot-rolled steel is subjected to a normalization thermal treatment;

optionally, such normalized steel is subjected to austenization, followed by quenching and tempering, with a minimum tempering temperature of 490° C.;

optionally, said rolled steel is directly subjected to austenization, quenching, and tempering.

3. A steel according to claim 2, wherein the hot rolling comprises:

a first heating stage conducted at temperatures substantially comprised within a range of 1200–1300° C. for a period of approximately 1 hour in an atmosphere of combustion gases with an $O_2$ content going from 1 to 1.5%, and a second heating stage conducted at a temperature substantially comprised within the range of 850–1100° C. for an approximate period of 30 minutes in an atmosphere of combustion gases with an $O_2$ content from 1 to 1.5%.

4. A steel according to claim 2 wherein the hot-roll is performed in a continuous roller of the floating or restrained mandrel type (Multi-stand Pipe Mill—MPM- or Continuous Mandrel Mill).

5. A low-alloy carbon steel according to claim 1, wherein said steel contains:

3.3% by weight of Cr, 0.08% by weight of C, 0.47% by weight of Mn, 0.001% by weight of S, 0.014% by weight of P, 0.28% by weight of Si, 0.29% by weight of Mo, 0.52% by weight of V, 0.22% by weight of Cu, 0.001% by weight of Nb, 0.028% by weight of Ti, not more than a total O of 25 ppm, with the balance being Fe and unavoidable impurities.

6. A process for the manufacture of low-alloy carbon steel seamless pipes for the exploration and the production of oil and/or natural gas having an improved resistance to corrosion according to claim 1, wherein such process comprises the following stages:

elaboration of an primary melt in an ultra-high power electric furnace, followed by a secondary metallurgy stage with a strong desulfurization, the addition of ferroalloys and Cr, and then the modification and flotation of the inclusions until a formulation comprising 1.5–4.0% by weight of Cr, 0.06–0.10% by weight of C, 0.3–0.8% by weight of Mn, not more than 0.005% by weight of S, not more than 0.015% by weight of P, 0.20–0.35% by weight of Si, 0.25–0.35% by weight of Mo, 0.06–0.9% by weight of V, approximately 0.22% by weight of Cu, approximately 0.001% by weight of Nb, approximately 0.028% by weight of Ti, not more than a total O of 25 ppm, with the balance being Fe and unavoidable impurities, is achieved;

casting by continuous casting;

rolling in a continuous roller, of the restrained or floating mandrel type (Multi-stand Pipe Mill (MPM) or continuous mandrel mill) following a first heating stage conducted at temperatures comprised substantially within the range of 1200–1300° C. for a period of approximately 1 hour in an atmosphere of combustion gases with an $O_2$ content going from 1 to 1.5%, and a second heating stage conducted at a temperature substantially comprised within the range of 850–1100° C. in an atmosphere of combustion gases with an $O_2$ content going from 1 to 1.5% for an approximate period of 30 minutes; and normalizing the rolled pipe by heating conducted at a temperature comprised between 850 and 950° C. for a period of about 60 minutes and its subsequent cooling in calm air.

7. A process to manufacture low-alloy carbon steel seamless pipes for the exploration and the production of oil and/or natural gas having an improved resistance to corrosion according to claim 1, wherein such process comprises the following stages:

elaboration of the primary melt in a ultra-high power electric furnace, followed by a secondary metallurgy stage with a strong desulfurization, addition of ferroalloys and Cr, and then the modification and flotation of the inclusions until a formulation comprising 1.5–4.0% by weight of Cr, 0.06–0.10% by weight of C, 0.3–0.8% by weight of Mn, not more than 0.005% by weight of S, not more than 0.015% by weight of P, 0.20–0.35% by weight of Si, 0.25–0.35% by weight of Mo, 0.06–0.9% by weight of V, approximately 0.22% by weight of Cu, approximately 0.001% by weight of Nb, approximately 0.028% by weight of Ti, not more than a total O of 25 ppm, with the balance being Fe and unavoidable impurities, is obtained;

casting by continuous casting;

rolling in a continuous roller, of the restrained or floating mandrel type (Multi-stand Pipe Mill (MPM) or continuous mandrel mill), following a first heating stage conducted at temperatures substantially comprised within the range of 1200–1300° C. for a period of approximately 1 hour in an atmosphere of combustion gases with an $O_2$ content going from 1 to 1.5%, and a second heating stage conducted at a temperature substantially comprised within the range of 850–1100° C. in an atmosphere of combustion gases with an $O_2$ content going from 1 to 1.5% for an approximate period of 30 minutes;

normalizing the rolled tube by heating at a temperature comprised between 850 and 950° C. for a period of approximately 60 minutes and the subsequent cooling in calm air; and austenizing, quenching, and tempering for periods of approximately 1 hour at temperatures comprised between 500 and 720°C.

8. A process for the manufacture of low-alloy carbon steel seamless pipes for the exploration and the production of oil and/or natural gas having an improved resistance to corrosion according to claim 1, wherein such process comprises the following stages:

elaboration of the primary melt in an ultra-high power electric furnace, followed by a secondary metallurgy stage with strong desulfurization, addition of ferroalloys and Cr, and then modification and flotation of inclusions until a formulation comprising 1.5–4.0% by weight of Cr, 0.06–0.10% by weight of C, 0.3–0.8% by weight of Mn, not more than 0.005% by weight of S, not more than 0.015% by weight of P, 0.20–0.35% by weight of Si, 0.25–0.35% by weight of Mo, 0.06–0.9% by weight of V, approximately 0.22% by weight of Cu, approximately 0.001% by weight of Nb, approximately 0.028% by weight of Ti, not more than a total O of 25 ppm, where the balance is given by Fe and unavoidable impurities, is obtained;

casting by continuous casting;

rolling in a continuous roller, of the restrained or floating mandrel type (Multi-stand Pipe Mill (MPM) or continuous mandrel mill), following a first heating stage conducted at temperatures substantially comprised within the range of 1200–1300° C. for a period of approximately 1 hour in an atmosphere of combustion gases with an $O_2$ content going from 1 to 1.5%, and a second heating stage conducted at a temperature substantially comprised within the range of 850–1100° C. in an atmosphere of combustion gases with an $O_2$ content going from 1 to 1.5% for an approximate period of 30 minutes; and austenizing, quenching, and tempering for periods of approximately 1 hour at temperatures ranging between 500 and 720° C.

9. A process according to claim 6, wherein casting by continuous casting is performed with a maximum overheating of 35° C. and a controlled superficial cooling of the bars in the continuous cast cooling plane not exceeding an average of 10° C./min at temperatures ranging between 900° C. and 500° C.

10. A process, according to claim 6, wherein the steel contains:

3.3% by weight of Cr, 0.08% by weight of C, 0.47% by weight of Mn, 0.001% by weight of S, 0.014% by weight of P, 0.28% by weight of Si, 0.29% by weight of Mo, 0.52% by weight of V, 0.22% by weight of Cu, 0.001% by weight of Nb, 0.028% by weight of Ti, not more than a total O of 25 ppm, with the balance being Fe and unavoidable impurities.

11. Low-alloy carbon steel seamless pipes for the exploration and the production of oil and/or natural gas having an improved resistance to corrosion, wherein such pipes are manufactured according to the process of claim 6.

* * * * *